US006573649B1

(12) United States Patent
Nakagawa et al.

(10) Patent No.: US 6,573,649 B1
(45) Date of Patent: Jun. 3, 2003

(54) COLOR PICTURE TUBE

(75) Inventors: Shinichiro Nakagawa, Saitama-ken (JP); Norio Shimizu, Saitama-ken (JP); Takashi Murai, Saitama-ken (JP); Masatsugu Inoue, Saitama-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/805,776

(22) PCT Filed: Sep. 17, 1999

(86) PCT No.: PCT/JP99/05070

§ 371 (c)(1),
(2), (4) Date: Mar. 19, 2001

(87) PCT Pub. No.: WO00/17904

PCT Pub. Date: Mar. 30, 2000

(30) Foreign Application Priority Data

Sep. 17, 1998 (JP) ..... 10-263155

(51) Int. Cl.[7] ..... H01J 29/10
(52) U.S. Cl. ..... 313/461; 313/447
(58) Field of Search ..... 313/447, 461; 348/821

(56) References Cited

U.S. PATENT DOCUMENTS

| | | | | |
|---|---|---|---|---|
| 4,623,818 A | | 11/1986 | Yamazaki | 313/408 |
| 4,697,119 A | | 9/1987 | Inoue et al. | 313/408 |
| 4,881,004 A | | 11/1989 | Inoue et al. | 313/408 |
| 5,155,410 A | * | 10/1992 | Wakasono et al. | 313/402 |
| 5,416,379 A | | 5/1995 | Inoue et al. | 313/402 |
| 5,631,520 A | | 5/1997 | Inoue et al. | 313/402 |
| 5,663,610 A | | 9/1997 | Inoue et al. | 313/461 |
| 6,025,676 A | | 2/2000 | Ohama et al. | 313/477 |
| 6,066,914 A | | 5/2000 | Shimizu et al. | 313/477 |
| 6,333,594 B1 | | 12/2001 | Nakagawa et al. | 313/461 |

FOREIGN PATENT DOCUMENTS

| | | | |
|---|---|---|---|
| EP | 0448401 | 3/1991 | |
| GB | 0 448 401 A2 * | 3/1991 | H01J/29/86 |
| JP | 55-28269 | 2/1980 | |
| JP | 59-165350 | 9/1984 | |
| JP | 6-76762 | 3/1994 | |
| JP | 7-153385 | 6/1995 | |
| JP | 8-50869 | 2/1996 | |
| JP | 2507466 | 4/1996 | |
| JP | 2645042 | 5/1997 | |
| JP | 9-245685 | 9/1997 | |
| JP | 10-241604 | 9/1998 | |
| JP | 11-144648 | 5/1999 | |
| JP | 11-238475 | 8/1999 | |
| JP | 6-302284 | 10/1999 | |

* cited by examiner

*Primary Examiner*—Sandra O'Shea
*Assistant Examiner*—Peter Macchiarolo
(74) *Attorney, Agent, or Firm*—Oblon, Spivak, McClelland, Maier & Neustadt, P.C.

(57) ABSTRACT

A color picture tube includes a panel of which substantially rectangular effective area has a flat external surface and a curved internal surface, and on the internal surface of the effective area thereof a phosphor screen is formed. The internal surface of the effective area of the panel, when an average radius of curvature in major axis direction is RH, an average radius of curvature in minor axis direction is RV, an average radius of curvature in long side direction is RL and an average radius of curvature in short side direction is RS, is formed in a curved face satisfying RH>RV and RS≧RV, or RH>RV and RS≧RV and RL≧RH. In this color picture tube, flatness of the effective area of the panel and visibility are improved.

5 Claims, 2 Drawing Sheets

COLOR PICTURE TUBE

BACKGROUND OF THE INVENTION (1) Field of the Invention

The present invention relates to a color picture tube, in particular to a color picture tube in which flatness of an image display portion and visibility is improved.

(2) Description of Related Art

In general, a color picture tube that is employed in a TV Braun tube, computer display or the like has a vacuum envelope consisting of a glass panel and a glass funnel of funnel shape. On an internal surface of the effective area that is an image display portion of the panel, a phosphor screen comprising phosphor layers of three colors, blue (B), green (G) and red (R), is formed. Electron beams emitted from electron guns that are disposed inside the neck of the funnel are deflected by a magnetic field generated by a deflection yoke disposed outside the funnel to scan the phosphor screen in a horizontal and vertical direction through a shadow mask, resulting in a display of color images.

The panel of the color picture tube comprises an effective area whose plane shape is essentially rectangular and a sidewall disposed in the surrounding area thereof. So as to obtain strength capable of supporting the weight of atmosphere applied on the vacuum envelope, the internal and external surfaces of the panel are formed with different curvatures, and the thickness thereof is formed to become thicker from the center portion of the effective area towards a periphery portion thereof.

In recent years, in order to improve visibility of images, the external surface of the effective area of the panel is being made flat (flattening). In order to improve the visibility, it is also necessary for the internal surface of the effective area to be flat. Nevertheless, in order to secure strength to support the curved surface of a shadow mask disposed inside the panel and strength of the vacuum envelope supporting atmospheric pressure, it had been extremely difficult to make the internal surface of the effective area of the panel flat to the level comparable with the external surface. In addition, from a viewpoint of the characteristics of a color picture tube, it was difficult to make the internal surface of the effective area flat.

Further, a phosphor screen is formed in contact with the internal surface of the effective area of the panel. The substantial image display portion is, when not taking into account the refractive index of the glass panel, a curved face that is the same as the internal surface of the effective area. Accordingly, so far there was a problem that images of high flatness could not be obtained without making the internal surface flat.

SUMMARY OF THE INVENTION

An object of the present invention is that in a color picture tube where the effective area of a panel is substantially rectangular, the internal surface of the effective area thereof is formed in a curved face having improved visibility to attain a better sense of flatness of images. At the same time, the strength that supports a curved surface of a shadow mask is secured and deterioration of color purity due to local thermal expansion of the shadow mask is prevented from occurring.

The present invention is a color picture tube, comprising a transparent panel of which an external surface is flat, and an internal surface is a curved face and a plane shape with a substantially rectangular effective area, and a phosphor screen disposed on the internal surface of the effective area of the panel, wherein RH>RV and RS≧RV, where RH is an average radius of curvature in major axis direction and denotes a radius of a curved line (an arc) that goes through a center of the internal surface of the effective area and ends on a major axis, RV is an average radius of curvature in minor axis direction and denotes a radius of an arc that goes through the center and ends of a minor axis on the internal surface of the effective area, and RS is an average radius of curvature in short side direction and denotes a radius of an arc that goes through an end of the major axis and ends of diagonal axes on the internal surface of the effective area.

Further, in the color picture tube according to the present invention, the internal surface of the effective area can be formed with a curved face that satisfies the following expressions (1), (2) and (3).

$$RH>RV \quad (1)$$

$$RS \geqq RV \quad (2)$$

$$RL \geqq RH \quad (3)$$

Here RL is an average radius of curvature in long side direction and denotes a radius of an arc that goes through an end of the minor axis and ends of the diagonal axes of the internal surface of the effective area.

In addition, the internal surface of the effective area can be formed with a curved face in which long sides that go through the end on the minor axis and the ends on the diagonal axes exist approximately on one plane.

Further, in a color picture tube in which the internal surface of the effective area of the panel satisfies all the aforementioned expressions (1), (2) and (3), wherein the internal surface of the effective area can be formed with a curved face that further satisfies the following expressions (4) and (5).

$$2<RH/RV<15 \quad (4)$$

$$1<RH/RD<10 \quad (5)$$

Incidentally, RD is an average radius of curvature in diagonal axis direction and denotes a radius of an arc that goes through the center and the ends of the diagonal axes of the internal surface of the effective area.

Further, in such a color picture tube, the internal surface of the effective area can be formed with a curved face that satisfies the following expression (6).

$$1<RS/RV<5 \quad (6)$$

Still further, the internal surface of the effective area can be formed in a curved face that satisfies the following expression (7).

$$3<RL/RH \quad (7)$$

DETAILED DESCRIPTION OF THE INVENTION

Figure 1:
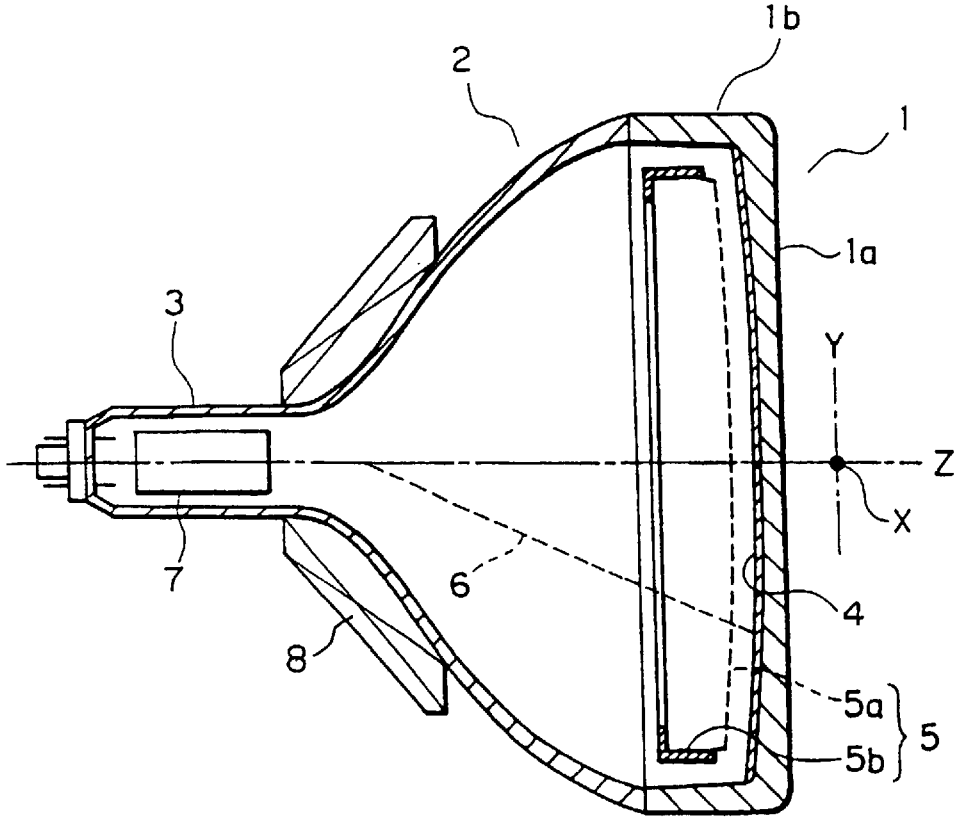
FIG. 1 is a diagram showing, with a cross-section, a schematic structure of a first embodiment of the present invention.

A color picture tube of the present invention, as shown in FIG. 1, comprises a vacuum envelope consisting of a glass panel 1 and a glass funnel 2 having the shape of a funnel, one end of the funnel 2 being a cylindrical neck 3. The panel 1 comprises an effective area 1*a* and a sidewall 1*b* disposed in the periphery thereof, the effective area 1*a* of the panel 1 being substantially rectangular in which a horizontal axis (X axis) crossing at a right angle with a tube axis (Z axis) is the major axis and a vertical axis (Y axis) crossing at a right angle with the tube axis is the minor axis.

Further, an external surface of the effective area 1*a* is approximately flat. However, the internal surface thereof is formed in a curved face that is expressed by a polynomial of higher order in which an average radius of curvature in major axis direction RH, an average radius of curvature in minor axis direction RV, an average radius of curvature in long side direction RL, an average radius of curvature in short side direction RS, and an average radius of curvature in diagonal axis direction RD satisfy the aforementioned expressions (1) through (7), respectively. Incidentally, in the present invention, that the external surface of the effective area 1*a* is approximately flat means that the average radius of curvature in diagonal axis direction is 10000 mm or more.

On the internal surface of the effective area 1*a* of the panel 1, a phosphor screen 4 comprising phosphor layers of three colors, blue (B), green (G) and red (R), is formed. Further, at a position a prescribed distance inwards of the phosphor screen 4, a shadow mask 5 consisting of a mask body 5*a* and a mask frame 5*b* set in the periphery of the mask body 5*a* is disposed. The mask body 5*a* is substantially rectangular and has a lot of holes electron beams go through in an effective surface consisting of a curved surface that faces the phosphor screen 4.

On the other hand, inside the neck 3 of the funnel 2, electron guns 7 that emit three electron beams 6 are disposed. The beams are arranged in a row that goes through the same horizontal plane. The electron beams 6 are deflected by a magnetic field generated by a deflection yoke 8 attached outside of the funnel 2. The deflected electron beams 6 scan the phosphor screen 4 in horizontal and vertical directions through holes of the shadow mask 5 that allow the electron beams to pass. Thereby, color images can be displayed.

In the color picture tube of the present invention, the internal surface of the effective area has a curved face to satisfy the following expressions.

$$RH>RV \quad (1)$$

$$RS\geqq RV \quad (2)$$

This is due to the following reasons.

First, as a model of curved face of the internal surface of the effective area, three models, that is, a major axis direction cylindrical surface that shows a cylindrical shape in the major axis (X axis) direction, a spherical surface, and a minor axis direction cylindrical surface that shows a cylindrical shape in the minor axis (Y axis) direction can be thought of With the amount of drop-off in tube axis (Z axis) direction maintained the same at the ends of the diagonal axes, the strengths of the curved faces are compared. In the spherical surface, over the entire surface, the strength is approximately the same. In the major axis direction cylindrical surface and minor axis direction cylindrical surface, the strengths are identical at the centers of the curved surfaces. However, the respective strengths at an intermediate area of the major axis direction and an intermediate area of the minor axis direction are remarkably weak compared with that of the center.

On the other hand, local thermal expansion of a shadow mask, in the order of the minor axis direction cylindrical surface, the spherical surface and the major axis direction cylindrical surface, becomes larger. When calculated in terms of amount of shift of an electron beam on a screen surface, with the shift of the minor axis direction cylindrical surface being 1, the shift of the spherical surface is 2, and the shift of the major axis direction cylindrical surface is 4. Accordingly, from both of the strength of a curved surface of a shadow mask and, suppression of deterioration of color purity due to local thermal expansion thereof, a curved face that is an intermediate of spherical surface and minor axis direction cylindrical surface is expected to be preferable.

Further, when RH<RV, RH is made sufficiently large with difficulty. In the case of the value of RH being not large, when the screen (effective area of a panel) is seen from the side, the opposite side of the screen can not be seen due to the convex center portion. Accordingly, flat images can not be displayed. In addition, an effective dimension in the horizontal axis (major axis) direction of the effective area of a panel is larger than that in vertical axis (minor axis) direction. Accordingly, when the value of RH is small, such as approximately 1300 mm, the thickness of the surrounding area in the horizontal direction of the panel increases. As a result of this, the panel is formed with difficulty, and its fabrication is not practical.

On the other hand, when the value of RH is large (for example approximately 18000 mm), if the value of RV is made larger than that of RH, it becomes difficult to obtain a shadow mask having strength sufficient for supporting a curved surface. That is, the shape of the effective surface of the shadow mask, in the case of value of the RV being 18000 mm or more to conform to the shape of the internal surface of the effective area of the panel, has insufficient strength to support the curved surface of the shadow mask. This is not desirable.

Further, in order to prevent deterioration of color purity due to thermal expansion by increasing the strength supporting the curved surface of the shadow mask, the average radius of curvature RS in short side direction of the internal surface of the effective area of a panel is preferable to be equal with or larger than the average radius of curvature in minor axis direction RV (RS≧RV). From the viewpoint of improvement of sense of flatness, the value of RS is preferable to be as large as possible. However, from the viewpoint of suppression of deterioration of the color purity due to the thermal expansion of the shadow mask, the value of RS is preferable to be small. Further, when the values of RS are the same, by forming the center portion of the short side in convex towards the center of the effective area, the sense of flatness is known to be improved (cf. Japanese Patent Application No. 10-40583). The shape of the internal surface of the effective area of a panel and the strength supporting the curved surface of a shadow mask will be explained in more detail.

In a shadow mask type color picture tube, from the operation principle thereof, a shadow mask is required to be disposed a definite distance away from an internal surface of a panel. Accordingly, in order to maintain the shape of the shadow mask consisting of a thin iron plate or Invar material having a low thermal expansion coefficient, in particular in the shadow masks that are produced by the use of presswork, the shape thereof must be formed in a curved surface.

Further, by increasing the pitch of holes which electron beams pass through from the center portion of the shadow mask towards the surrounding portion thereof, even when the internal surface of the panel is made flat, the effective surface of the shadow mask can be formed in a curved surface with a large radius of curvature. However, since the pitch of the holes influences resolution power of a color picture tube, the variation rate of the pitch is preferable not to be larger than a certain degree. Further, recently, since the pitch of the holes that the beam pass through is required to be uniform up from the center portion to a periphery portion, the internal surface of the panel and the shadow mask are required to be curved surfaces having the same radii of curvature.

Thus, the internal surface of the panel must be a curved face that can give a sufficient degree of strength to support the shadow mask disposed opposite thereto. Furthermore, since color purity of images is deteriorated due to local thermal expansion of the shadow mask, in order to prevent the deterioration of the color purity from occurring, the internal surface of the effective area of the panel must be formed in a curved face having a certain degree of radius of curvature, particularly in major axis direction.

As described above, in a color picture tube of the present invention, in addition to an external surface of the effective area of a panel being flat, an internal surface thereof is formed in a curved face satisfying the aforementioned expressions (1) and (2). Accordingly, the strength of vacuum envelope against atmospheric pressure is maintained high and, compared with the existing color picture tube, images of improved visibility and sense of flatness can be displayed. In addition, the strength supporting the curved surface of the shadow mask is maintained high and deterioration of the color purity due to thermal expansion of the shadow mask can be prevented from occurring. Thus, a color picture tube of high display quality can be realized.

Further, in the present invention, the following expression (3) is preferable to be satisfied.

$$RL \geqq RH \quad (3).$$

When the average radius of curvature in long side direction RL is larger than or equal with the average radius of curvature in major axis direction RH, the long side of the effective area of the panel becomes approximately a straight line unrelated to the angle viewing the screen. Accordingly, the sense of flatness of the screen can be improved further.

Further, in the present invention, an internal surface of the effective area of a panel is preferred to be a curved face satisfying the following expressions $$2 < RH/RV < 15 \quad (4)$$

and $$1 < RH/RD < 10 \quad (5),$$

and further preferred to satisfy at least one of the following expressions (6) and (7).

$$1 \leqq RS/RV < 5 \quad (6)$$

$$3 < RL/RH \quad (7)$$

The preferable ranges shown in the expressions (4) and (5) are necessary and sufficient for preventing deterioration of color purity due to local thermal expansion of a shadow mask and the difference of the panel thicknesses of the center portion and the periphery from becoming too large. When the value of RH/RV is 2 or less, or the value of RH/RD is 1 or less, the deterioration of the color purity due to the local thermal expansion of the shadow mask can not be sufficiently prevented. On the contrary, when the value of RH/RV exceeds 15, or the value of RH/RD exceeds 10, the differences of the thicknesses between the end in minor axis direction and the end in major axis direction, and the end in major axis direction and the end in diagonal axis direction become too large.

The expression (6) ($1 \leqq RS/RV < 5$) is a condition required from flatness of the screen. That is, when the screen (effective area of a panel) is seen from the side, in order for the visibility of the short side not to damage the flatness, the value of RS/RV is necessary to be 1 or more ($RS \geqq RV$). Further, when the value of RS/RV is made 5 or more, the local thermal expansion of the shadow mask becomes large, resulting in deterioration of the color purity of the screen. This is not desirable.

In order to improve flatness, $3 < RL/RH$ is preferable. That is, in order to enhance further the sense of flatness of the screen, in the internal surface of the effective area of a panel, it is desirable to set the value of RL at 15000 mm or more and to make the long side a straight line on approximately the same plane. When the internal surface is a curved face close to spherical surface, since the value of RH becomes 5000 mm at the maximum, to make the long side an approximate straight line, the preferable range of the value of RL/RH is 3 or more.

In the following, preferred embodiments of the present invention will be explained in more detail. Incidentally, the present invention is not restricted to the following embodiments.

Embodiment 1

Figure 2:
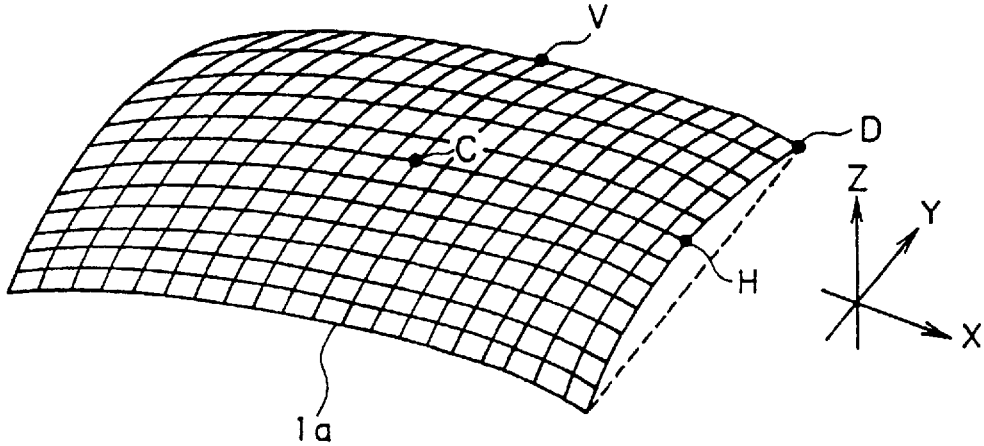
FIG. 2 is a diagram schematically showing a shape of an internal surface of an effective area of a panel in the first embodiment.
Figure 4:
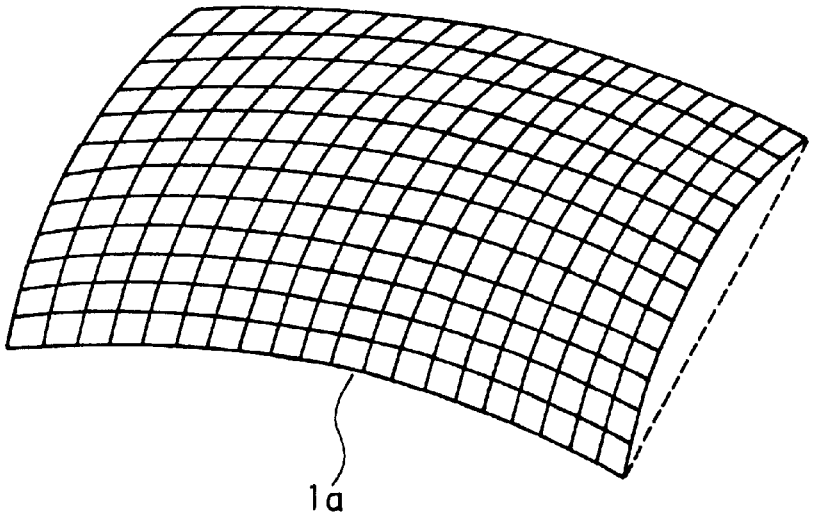
FIG. 4 is a diagram schematically showing a shape of an internal surface of an effective area of a panel of an existing color picture tube.

In a color picture tube of which an aspect ratio of breadth and height is 16:9 and a diagonal dimension is 76 cm, an external surface of an effective area of a panel is made approximately flat (average radius of curvature in diagonal axis direction is 10000 mm or more), and an internal surface thereof is formed in a curved face expressed by a polynomial of higher order. The shape of this curved face is shown schematically in FIG. 2. For comparison purpose, the shape of an internal surface of an effective area of a panel of an existing color picture tube is shown in FIG. 4.

In the internal surface of the effective area of the panel, with a center C as the origin of the coordinate axes, coordinates (x, y, z) of an end point H of a major axis (X-axis), an end point V of a minor axis (Y-axis) and an end point D of a diagonal axis are shown in Table 1, respectively. Incidentally, minus signs of z-values of the respective end points H, V and D show that the respective end points H, V and D drop off with respect to the center C in a direction perpendicular to the plane of the paper.

TABLE 1

| | Coordinate (mm) (x, y, z) | | |
|---|---|---|---|
| Center C | Horizontal axis end (major axis end) H | Vertical axis end (minor axis end) V | Diagonal axis end D |
| (0, 0, 0) | (330, 0, −5) | (0, 186, −13) | (330, 186, −17) |

Further, average radii of curvature in major axis direction RH, in minor axis direction RV, in long side direction RL, and in short side direction RS are shown in Table 2, respectively.

TABLE 2

| Average radius of curvature (mm) | | | |
|---|---|---|---|
| RH | RL | RV | RS |
| 10893 | 13656 | 1337 | 1448 |

As shown in Table 2, in the panel of the color picture tube of Embodiment 1, the internal surface of the effective area is a curved face that satisfies all of the following expressions.

$$RH>RV \quad (1)$$

$$RS \geqq RV \quad (2)$$

$$RL \geqq RH \quad (3)$$

As a result of this, the color picture tube, in addition to the external surface being flat, is further improved in visibility and can display images with an excellent sense of flatness. In addition, since strength supporting a curved surface of a shadow mask can be maintained sufficiently large and deterioration of the color purity due to thermal expansion is prevented from occurring, images of high quality can be displayed.

Embodiment 2

Figure 3:
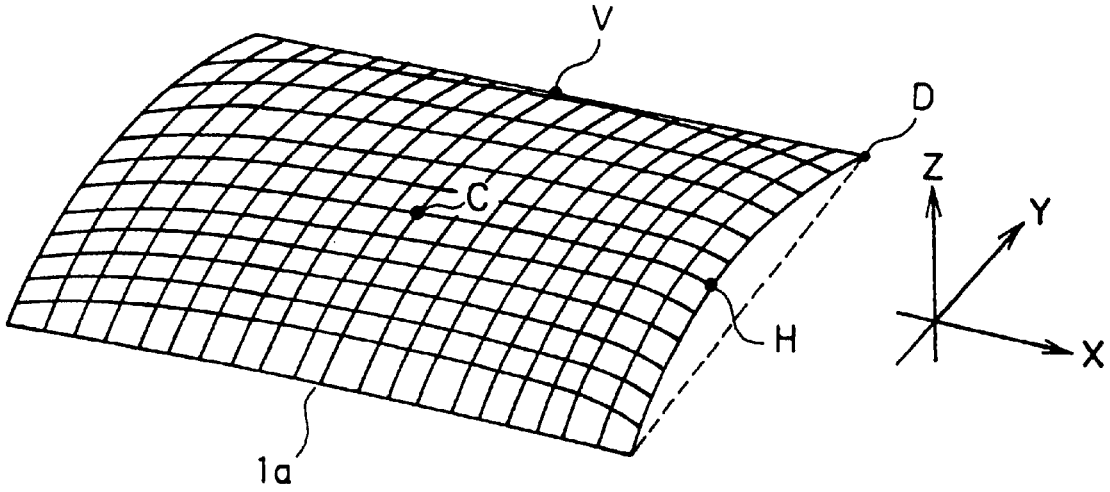
FIG. 3 is a diagram schematically showing a shape of an internal surface of an effective area of a panel in a second embodiment of the present invention.

As in embodiment 1, in a color picture tube of which an aspect ratio of breadth and height is 16:9 and a diagonal dimension is 76 cm, an external surface of an effective area of a panel is made approximately flat, and an internal surface thereof is formed in a curved face that is expressed by a polynomial of higher order shown in FIG. 3.

In the internal surface of the effective area of the panel, with the center C as the origin of the coordinate axes, coordinates (x, y, z) of an end point H of a major axis, an end point V of a minor axis and an end point D of a diagonal axis are shown in Table 3, respectively.

TABLE 3

| Coordinate (mm) (x, y, z) | | | |
|---|---|---|---|
| Center C | Major axis end H | Minor axis end V | Diagonal axis end D |
| (0, 0, 0) | (330, 0, −3) | (0, 186, −16) | (330, 186, −17) |

Further, the average radii of curvature in major axis direction RH, in minor axis direction RV, in long side direction RL and in short side direction RS are shown in Table 4, respectively.

TABLE 4

| Average radius of curvature (mm) | | | |
|---|---|---|---|
| RH | RL | RV | RS |
| 18152 | 54616 | 1089 | 1243 |

As shown in Table 4, in the panel of the color picture tube of Embodiment 2, the internal surface of the effective area is a curved face that satisfies all of the above expressions (1) through (3). In particular in this embodiment, the internal surface of the effective area is formed in a shape that has thickness difference of the panel of 1 mm on the long side.

Further, when the difference of coordinates on the long side in tube axis direction is approximately 2 mm, the long side can be located approximately on the same plane. As shown in Table 3, in the panel of the present embodiment, since the difference of the coordinates in the tube axis direction of the minor axis end point V and the diagonal axis end point D is 1 mm (17 mm−16 mm), the long side is approximately on the same plane and forms a straight line. By the way, the difference of coordinates in tube axis direction of the major axis end point H and diagonal axis end point D is as large as 14 mm (17 mm−3 mm). Accordingly, the short side is not on the same plane.

Thus, in the color picture tube of Embodiment 2, the internal surface of the effective area of the panel is formed in a curved face as described above and the long side is approximately on the same plane. Accordingly, the flatness is further improved and the visibility is improved. In addition, compared with the color picture tube of Embodiment 1, a shadow mask can be formed in a curved surface of larger strength for supporting the curved surface. Accordingly, deterioration of color purity due to thermal expansion of the shadow mask can be prevented from occurring.

Embodiment 3

As in embodiment 1, in a color picture tube of which an aspect ratio of breadth and height is 16:9 and a diagonal dimension is 76 cm, an external surface of an effective area of a panel is made approximately flat, and an internal surface thereof is formed in a curved face expressed by a polynomial of higher order.

In the internal surface of the effective area of the panel, with the center C as the origin of the coordinate axes, coordinates (x, y, z) of an end point of a major axis H, an end point of a minor axis V and an end point of a diagonal axis D are shown in Table 5, respectively.

TABLE 5

| Coordinate (mm) (x, y, z) | | | |
|---|---|---|---|
| Center C | Major axis end H | Minor axis end V | Diagonal axis end D |
| (0, 0, 0) | (331, 0, −8) | (0, 186, −12) | (331, 186, −13) |

Further, at this time, the average radii of curvature in major axis direction RH, in minor axis direction RV, in long side direction RL, in short side direction RS, and in diagonal axis direction RD are obtained, respectively. In addition, the values of ratios of the respective average radii of curvature (RH/RV, RH/RD, RL/RH and RS/RV) are calculated, respectively. These results are shown in Table 6.

TABLE 6

| Average radius of curvature (mm) | | | | |
|---|---|---|---|---|
| RH | RL | RV | RS | RD |
| 6852 | 54781 | 1448 | 3462 | 5551 |
| **Ratio of average radii of curvature** | | | | |
| RH/RV | RH/RD | RL/RH | RS/RV | |
| 4.7 | 1.2 | 8.0 | 2.4 | |

As shown in Table 6, in the panel of the color picture tube of Embodiment 3, the internal surface of the effective area is a curved face that satisfies all of the following expressions.

$$2<RH/RV<15 \quad (4)$$

$$1<RH/RD<10 \quad (5)$$

$$1 \leqq RS/RV<5 \quad (6)$$

$$3<RL/RH \quad (7)$$

Accordingly, the panel of Embodiment 3, in addition to having a flat external surface, is further improved in visibility and can display images of excellent sense of flatness. Further, the strength supporting the curved surface of a shadow mask is kept sufficiently large and the color purity is prevented from deteriorating due to thermal expansion. Accordingly, images of excellent quality can be displayed. Further, in the panel of the color picture tube, when the screen is seen from an oblique direction of an angle of view of 45°, the short side is seen as a curved line that is convex towards outside of the effective area and has a sufficiently large radius of curvature (radius of curvature R is approximately 18700 mm). Accordingly, a satisfying sense of flatness of the screen can be obtained.

Embodiment 4

In a color picture tube of which an aspect ratio of breadth and height is 4:3 and a diagonal dimension is 68 cm, an external surface of an effective area of a panel is made approximately flat, and an internal surface thereof is formed in a curved face expressed by a polynomial of higher order.

In the internal surface of the effective area of the panel, with the center C as the origin of the coordinate axes, coordinates (x, y, z) of an end point of a major axis H, an end point of a minor axis V and an end point of a diagonal axis D are shown in Table 7, respectively.

TABLE 7

| Coordinate (mm) (x, y, z) | | | |
|---|---|---|---|
| Center C | Major axis end H | Minor axis end V | Diagonal axis end D |
| (0, 0, 0) | 272, 0, −8) | (0, 204, −13) | (204, 186, −14) |

Further, an average radii of curvature in major axis direction RH, in minor axis direction RV, in long side direction RL, in short side direction RS, and in diagonal axis direction RD are obtained, respectively. In addition, the values of ratios of the respective average radii of curvature (RH/RV, RH/RD, RL/RH and RS/RV) are calculated, respectively. These results are shown in Table 8.

TABLE 8

| Average radius of curvature (mm) | | | | |
|---|---|---|---|---|
| RH | RL | RV | RS | RD |
| 6628 | 36978 | 1607 | 3471 | 4136 |
| **Ratio of average radii of curvature** | | | | |
| RH/RV | RR/RD | RL/RH | RS/RV | |
| 2.88 | 1.12 | 7.99 | 2.16 | |

As shown in Table 8, in the panel of the color picture tube of Embodiment 4, the internal surface of the effective area is, as in Embodiment 3, a curved face that satisfies all of the aforementioned expressions (4) through (7). Accordingly, the panel of Embodiment 4 has a flat external surface and the visibility thereof is further improved. The strength supporting the curved surface of a shadow mask is kept sufficiently large and the color purity is prevented from deteriorating due to thermal expansion.

Accordingly, images of excellent quality can be displayed. Further, in the panel of the color picture tube, when the screen is seen from an oblique direction with an angle of view of 45°, the short side is seen as a curved line that is convex towards outside of the effective area and has a sufficiently large radius of curvature (radius of curvature R is approximately 18500 mm). Accordingly, a satisfying sense of flatness of the screen can be obtained.

As obvious from the above description, according to the present invention, an internal surface of an effective area of a panel can be formed in a curved face satisfying the following expressions, $$RH>RV \text{ and } RS\geqq RV$$

or $$RH>RV \text{ and } RS\geqq RV \text{ and further } RL\geqq RH.$$

Accordingly, in addition to the strength of vacuum envelope against atmospheric pressure being maintained sufficiently high, the visibility of images is improved and the images are displayed with a sense of flatness. In addition, the strength supporting a curved surface of a shadow mask is maintained high enough and deterioration of the color purity due to thermal expansion of the shadow mask can be prevented from occurring.

Further, in the present invention, the ratios of average radii of curvature of the internal surface of the effective area are restricted in the ranges of $$2<RH/RV<15 \text{ and } 1<RH/RD<10.$$

Thereby, in particular when seen from an oblique direction, the flatness of the screen can be further improved.

What is claimed is:

1. A color picture tube, comprising:

a transparent panel of which external surface is flat and internal surface is a curved face and plane shape has a substantially rectangular effective area; and a phosphor screen disposed on the internal surface of the effective area of the panel;

wherein RH>RV, RS≧RV, 2<RH/RV<15 and 1<RH/RD<10, where RH is an average radius of curvature in major axis direction and denotes a radius of an arc that goes through a center of the internal surface of the effective area and ends on a major axis, RV is an average radius of curvature in minor axis direction and denotes a radius of an arc that goes through the center and ends of a minor axis on the internal surface of the effective area, RS is an average radius of curvature in short side direction and denotes a radius of an arc that goes through an end of the major axis and ends of diagonal axes on the internal surface of the effective area, and RD is an average radius of curvature in diagonal axis direction and denotes a radius of an arc that goes through the center and the ends of the diagonal axes of the internal surface of the effective area.

2. The color picture tube as set forth in claim 1:

wherein RL≧RH, where RL is an average radius of curvature in long side direction and denotes a radius of an arc that goes through an end of the minor axis and ends of the diagonal axes of the internal surface of the effective area.

3. The color picture tube as set forth in claim 1:

wherein, in the internal surface of the effective area, long sides that go through the end of the minor axis and the ends of the diagonal axes exist approximately on a plane.

4. The color picture tube as set forth in claim 1:

wherein 1≦RS/RV<5.

5. The color picture tube as set forth in claim 2:

wherein 3<RL/RH.

* * * * *